United States Patent [19]

Allen

[11] Patent Number: 5,065,907

[45] Date of Patent: Nov. 19, 1991

[54] INSTANT SEALING SPRAY CANISTER

[76] Inventor: Ernest W. Allen, 607 E. Miller Rd., Midland, Mich. 48640

[21] Appl. No.: 530,106

[22] Filed: May 17, 1990

Related U.S. Application Data

[63] Continuation-in-part of Ser. No. 360,105, Jun. 1, 1989, abandoned.

[51] Int. Cl.[5] ..... B67D 5/06

[52] U.S. Cl. ..... 222/183; 222/325; 222/400.7

[58] Field of Search ..... 222/4, 5, 325, 399, 222/400.7, 183, 130, 131

[56] References Cited

U.S. PATENT DOCUMENTS

| | | | |
|---|---|---|---|
| 1,935,973 | 11/1933 | Altmann | 222/399 |
| 2,197,763 | 4/1940 | Kahn | 222/131 |
| 2,220,146 | 11/1940 | Curry | 222/4 |
| 2,967,421 | 1/1961 | Darbo | 222/5 |
| 3,428,218 | 2/1969 | Coja | 222/400.7 |
| 3,487,979 | 7/1970 | Altounyan et al. | 222/183 |
| 3,907,490 | 9/1975 | Schaller | 222/5 |
| 3,913,802 | 10/1975 | DiIanni | 222/400.7 |
| 4,043,744 | 8/1977 | Svensson | 222/5 |
| 4,208,013 | 6/1980 | Coleman et al. | 222/325 |
| 4,275,774 | 6/1981 | Andersen et al. | 222/325 |
| 4,402,430 | 9/1983 | Fox et al. | 222/183 |
| 4,667,856 | 5/1987 | Nelson | 222/325 |
| 4,836,414 | 6/1989 | Credle, Jr. et al. | 222/400.7 |

FOREIGN PATENT DOCUMENTS

| | | | |
|---|---|---|---|
| 195789 | 2/1958 | German Democratic Rep. | 222/400.7 |

*Primary Examiner*—Michael S. Huppert
*Assistant Examiner*—Kenneth Bomberg
*Attorney, Agent, or Firm*—Merlin B. Davey

[57] ABSTRACT

This invention provides a spray canister comprising an outer housing an an inner housing, each housing having a concave base, the base of said inner housing being adapted to mate with the base of said outer housing, said outer housing having first and second oppositely disposed openings, said first opening being adapted to receive said inner housing, said outer housing having a top portion fitted with spring means and sealing means, and having inlet means for applying air pressure to said inner housing and means adapted for operative connection with a spraying head for dispensing material from said inner housing, said inner housing being adapted to contain material to be sprayed and having a top portion adapted to sealingly contact the sealing means of said outer housing when said inner housing is inserted in said outer housing.

1 Claim, 1 Drawing Sheet

INSTANT SEALING SPRAY CANISTER

CROSS-REFERENCE TO RELATED APPLICATION

This application is a continuation-in-part of application Ser. No. 360,105, filed June 1, 1989, now abandoned.

BACKGROUND OF THE INVENTION

A continuing problem in the application of liquid materials such as, for example, paints, fertilizers, herbicides, insecticides and other treatment liquids, including solutions and suspensions, is that of insuring a desired, uniform application. Clearly, non-uniform application will provide non-uniform results and such results will vary from ineffective treatment to excessive treatment which can be both costly and damaging in some uses, such as in agricultural sprays.

Various attempts have been made to overcome these problems, as seen, for example, in U.S. Pat. Nos. 3,902,667 and 4,260,107. Such systems generally employ pumps and it has been found that pumps do not always deliver a constant volume because of several factors such as wear, clogging or a variation in the power to the pump itself. Electrically controlled systems, because of the possibility of igniting volatile carriers, are not desirable for safety reasons, particularly when liquids are to be sprayed in relatively confined spaces.

SUMMARY OF THE INVENTION

This invention provides a novel canister for spraying liquids. More particularly, this invention provides a novel spray canister comprising an outer housing and an inner housing, each housing having a concave base, the base of said inner housing being adapted to mate with the base of said outer housing, said outer housing having first and second oppositely disposed openings, said first opening being adapted to receive said inner housing, said outer housing having a top portion fitted with spring means and sealing means, and having inlet means for applying air pressure to said inner housing and means adapted for operative connection with a spraying head for dispensing material from said inner housing, said inner housing being adapted to contain material to be sprayed and having a top portion adapted to sealingly contact the sealing means of said outer housing when said inner housing is inserted in said outer housing. The novel canister of t[:is invention is advantageously employed with an air-driven hydraulic system for spraying liquids comprising a double acting cylinder having a central piston with an oil supply to one side of the piston and an air supply to the other side of the piston and means for alternately controlling the supply of air and oil to the cylinder thereby moving the piston in opposite directions as desired. The apparatus further comprises a rail or track having a mobile carrier positioned thereon, said carrier being adapted to be reciprocally moved by cable means attached to said piston and said carrier. The spray canister is attached to said carrier and is connected to a source of pressurized air, or other inert gas, by a coiled, flexible hose or other means, as desired.

DESCRIPTION OF THE PREFERRED EMBODIMENT

The invention is further illustrated by the accompanying drawings wherein.

Figures 1, 2, 3:
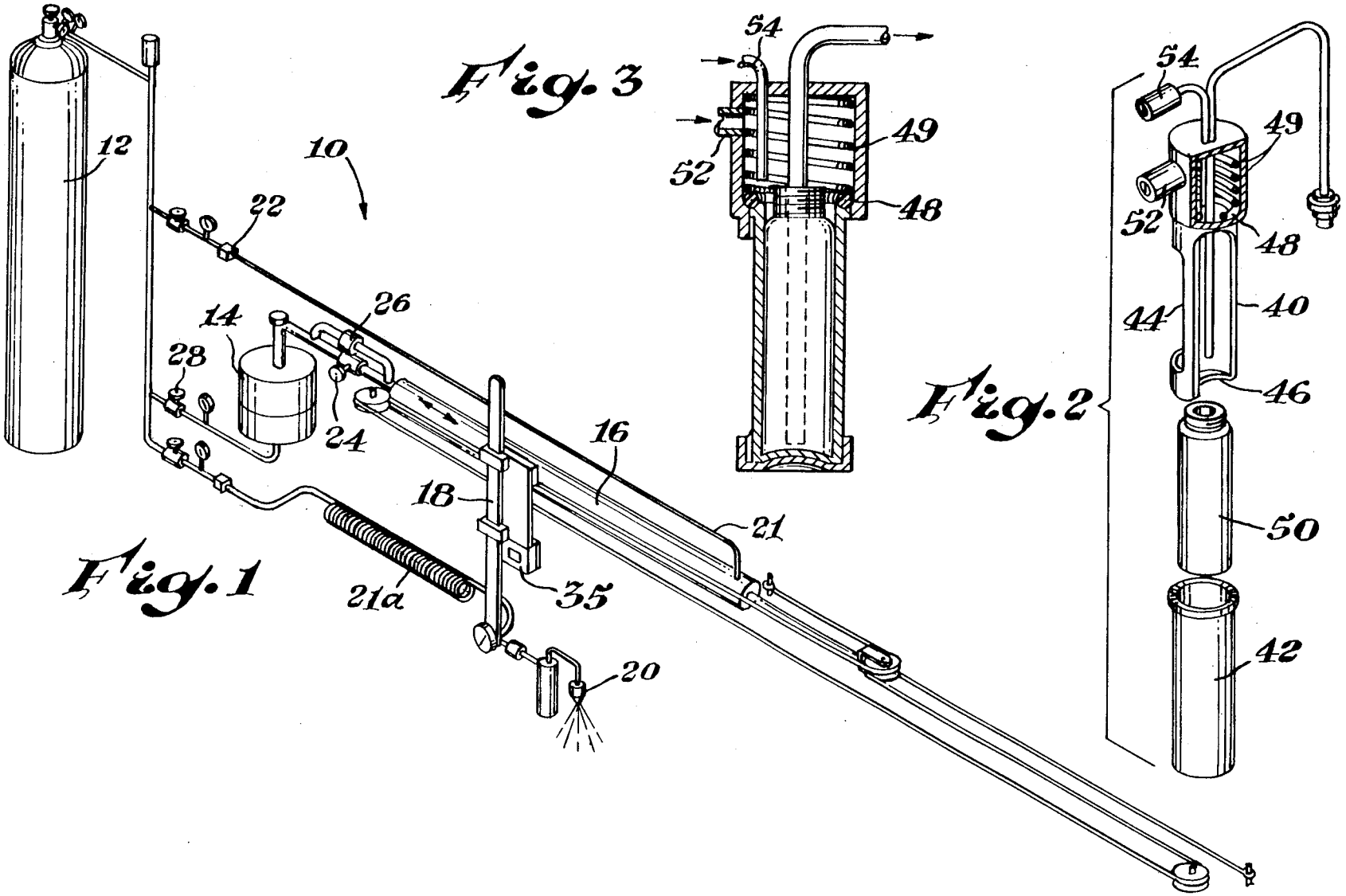
FIG. 1 is an isometric view of one embodiment of an apparatus suitable for use with the spray canister of this invention.
FIG. 2 is an exploded view, partially in section of the unique spray canister of this invention.
FIG. 3 is a sectional view of the spray canister of this invention showing a vial in place in the canister.

As shown in the accompanying FIG. 1, air, or other inert gas, can be supplied to the system (10) from, for example, a compressed air tank (12), generally at a pressure of about 80 psi (gauge) and oil is supplied from a tank, such as, for example, a bladder tank (14). As indicated in FIG. 1, air can be supplied to the spray canister through air supply line (21*a*). Air provided through three-way valve (22) and line (21) to the cylinder (16) drives the piston to the left and forces the carrier (18) to the right. The desired speed of carrier movement is controlled and set by speed control flow valve (24). Actual spraying can be controlled by on-off switches (not shown) and can be timed by a stop watch timer. Because the air pressure is constant, the speed of travel of the carrier to the right is constant at the desired setting and spray dispersal will be uniform. After the spraying action, the three-way valve (22) permits the venting of air from the cylinder, the oil pressure will force the piston to the right and the cable means will retract the carrier to the start position, the by-pass check valve (26) permitting a high flow of oil and a high speed return of the carrier to the start position.

Air pressure in the bladder tank (14) can be advantageously controlled by, for example, a fast bleeding regulator (28), at a pressure of about 12 psi (gauge). The rate of bleeding off of air pressure through the fast bleeding regulator determines the acceleration of the carrier and spraying head as they are moving to the right.

The spraying head 20 is attached to a spray canister shown in FIG. 2 having an outer housing (40) and an inner housing (42), each housing having a slightly concave base. The outer housing comprises generally oppositely disposed openings (44) and (46). Opening (46) being adapted to receive the inner housing (42) which is inserted therein and comes into contact with O-ring (48) which is held in place by coil spring (49), forming an instant seal therewith. Opening (44) is adapted for applying hand pressure for removal of inner housing (42) by finger pressure of one hand.

As can be seen in FIG. 2, the solution to be sprayed is placed in vial 50 which is then inserted into inner housing 42 and the combination is inserted into outer housing 40. As can be seen in FIG. 2, air pressure applied through inlet 52 forces the solution out through spraying head 20. Because the pressure is uniform on all side of vial 50, said vial need not be made of pressure resistant material. If it is desired to rinse the vial 50 and spray head 20 after the spray application is complete, a rinse solution, for example, acetone, can be applied through inlet 54.

Various modifications may be made in the apparatus of the present invention without departing from the spirit or scope thereof and it is understood that I limit myself only as defined in the appended claims.

I claim:

1. A spray canister comprising an outer housing and an inner housing, each housing having a concave base, the base of said inner housing being adapted to mate with the base of said outer housing, said outer housing having first and second oppositely disposed openings, said first opening being adapted to receive said inner housing, said outer housing having a top portion fitted with spring means and sealing means, and having inlet means for applying air pressure to said inner housing and means adapted for operative connection with a spraying head for dispensing material from said inner housing, said inner housing to receive a vial of material to be sprayed and having a top portion adapted to instantly sealingly contact the sealing means of said outer housing when said inner housing is inserted in said outer housing.

* * * * *